US011571891B2

(12) United States Patent
Koike et al.

(10) Patent No.: US 11,571,891 B2
(45) Date of Patent: Feb. 7, 2023

(54) LIQUID DISCHARGE HEAD

(71) Applicant: Seiko Epson Corporation, Toyko (JP)

(72) Inventors: Harunobu Koike, Matsumoto (JP); Koji Sumi, Shiojiri (JP); Masao Nakayama, Shiojiri (JP)

(73) Assignee: SEIKO EPSON CORPORATION

( * ) Notice: Subject to any disclaimer, the term of this patent is extended or adjusted under 35 U.S.C. 154(b) by 80 days.

(21) Appl. No.: 17/190,494

(22) Filed: Mar. 3, 2021

(65) Prior Publication Data

US 2021/0276329 A1 Sep. 9, 2021

(30) Foreign Application Priority Data

Mar. 4, 2020 (JP) ..... JP2020-036627

(51) Int. Cl.
*B41J 2/14* (2006.01)

(52) U.S. Cl.
CPC .. *B41J 2/14201* (2013.01); *B41J 2002/14491* (2013.01)

(58) Field of Classification Search
CPC ..... B41J 2/14201; B41J 2002/14491; B41J 2/14233; B41J 2002/14419; B41J 2202/11; B41J 2/01; B41J 2/14
See application file for complete search history.

(56) References Cited

U.S. PATENT DOCUMENTS

| | | | |
|---|---|---|---|
| 8,104,155 | B2 | 1/2012 | Mita |
| 2018/0154652 | A1 | 6/2018 | Yazaki |
| 2019/0077151 | A1 | 3/2019 | Hirai et al. |
| 2021/0023845 | A1 | 1/2021 | Yazaki |

FOREIGN PATENT DOCUMENTS

| | | | | | |
|---|---|---|---|---|---|
| CN | 108146074 | A | * | 6/2018 | ..... B41J 2/045 |
| CN | 108146074 | A | | 6/2018 | |
| CN | 109484033 | A | | 3/2019 | |
| JP | 2009239208 | A | | 10/2009 | |
| JP | 2010208204 | A | | 9/2010 | |

OTHER PUBLICATIONS

IP.com search (Year: 2022).*

* cited by examiner

*Primary Examiner* — Lisa Solomon
(74) *Attorney, Agent, or Firm* — Harness, Dickey & Pierce, P.L.C.

(57) ABSTRACT

A recording head includes a pressure chamber and a piezoelectric actuator configured to change a volume of the pressure chamber. The piezoelectric actuator includes a vibration plate forming one wall surface of the pressure chamber, a lower electrode formed on the vibration plate, a piezoelectric body formed on the lower electrode, and an upper electrode formed on the piezoelectric body and the vibration plate. When viewed from a ±Z direction orthogonal to the vibration plate, the lower electrode and the piezoelectric body do not overlap a central portion of the pressure chamber, when viewed from the ±Z direction, the lower electrode, the piezoelectric body, and the upper electrode overlap an end portion of the pressure chamber, and when viewed from the ±Z direction, the upper electrode overlaps the central portion of the pressure chamber.

4 Claims, 8 Drawing Sheets

LIQUID DISCHARGE HEAD

The present application is based on, and claims priority from JP Application Serial Number 2020-036627, filed Mar. 4, 2020, the disclosure of which is hereby incorporated by reference herein in its entirety.

BACKGROUND

1. Technical Field

The present disclosure relates to a liquid discharge head.

2. Related Art

A liquid discharge head using a piezoelectric element is configured to cause a pressure fluctuation in liquid in a pressure chamber by driving the piezoelectric element, and discharge the liquid from a nozzle communicating with the pressure chamber. A part of the pressure chamber is a vibration plate made of a flexible member, and a lower electrode, a piezoelectric body made of a piezoelectric material such as lead zirconate titanate (PZT), and an upper electrode are stacked on the vibration plate by a film forming technique. In a liquid discharge head disclosed in JP-A-2010-208204, an upper electrode, a piezoelectric body, and a lower electrode are arranged so as not to overlap a central portion of a pressure chamber in a plan view, that is, when viewed from a stacking direction of each layer.

However, in the liquid discharge head described in JP-A-2010-208204, an interface between the piezoelectric body and the vibration plate is exposed on the vibration plate on the pressure chamber having a large deformation, and cracks easily occur at the interface by repeatedly driving the piezoelectric element. In such a situation, when the piezoelectric element is exposed to a high humidity environment, moisture may directly adhere to the piezoelectric body having cracks and a leakage current may increase.

SUMMARY

A liquid discharge head includes: a pressure chamber; and a piezoelectric actuator configured to change a volume of the pressure chamber. The piezoelectric actuator includes a vibration plate forming one wall surface of the pressure chamber, a lower electrode formed on the vibration plate, a piezoelectric body formed on the lower electrode, and an upper electrode formed on the piezoelectric body and the vibration plate. When viewed from a first direction orthogonal to the vibration plate, the lower electrode and the piezoelectric body do not overlap a central portion of the pressure chamber, when viewed from the first direction, the lower electrode, the piezoelectric body, and the upper electrode overlap an end portion of the pressure chamber, and when viewed from the first direction, the upper electrode overlaps the central portion of the pressure chamber.

DESCRIPTION OF EXEMPLARY EMBODIMENTS

Hereinafter, embodiments for carrying out the present disclosure will be described with reference to the accompanying drawings. In the embodiments described below, various limitations are given as preferred specific examples of the present disclosure, but the scope of the present disclosure is not limited to these aspects unless it is stated in the following description that the present disclosure is particularly limited. Further, in the following, an inkjet type printer (hereinafter, a printer) which is a kind of liquid discharge device equipped with an inkjet type recording head (hereinafter, a recording head) which is a kind of liquid discharge head according to the present disclosure will be described as an example.

1. First Embodiment

Figure 1:
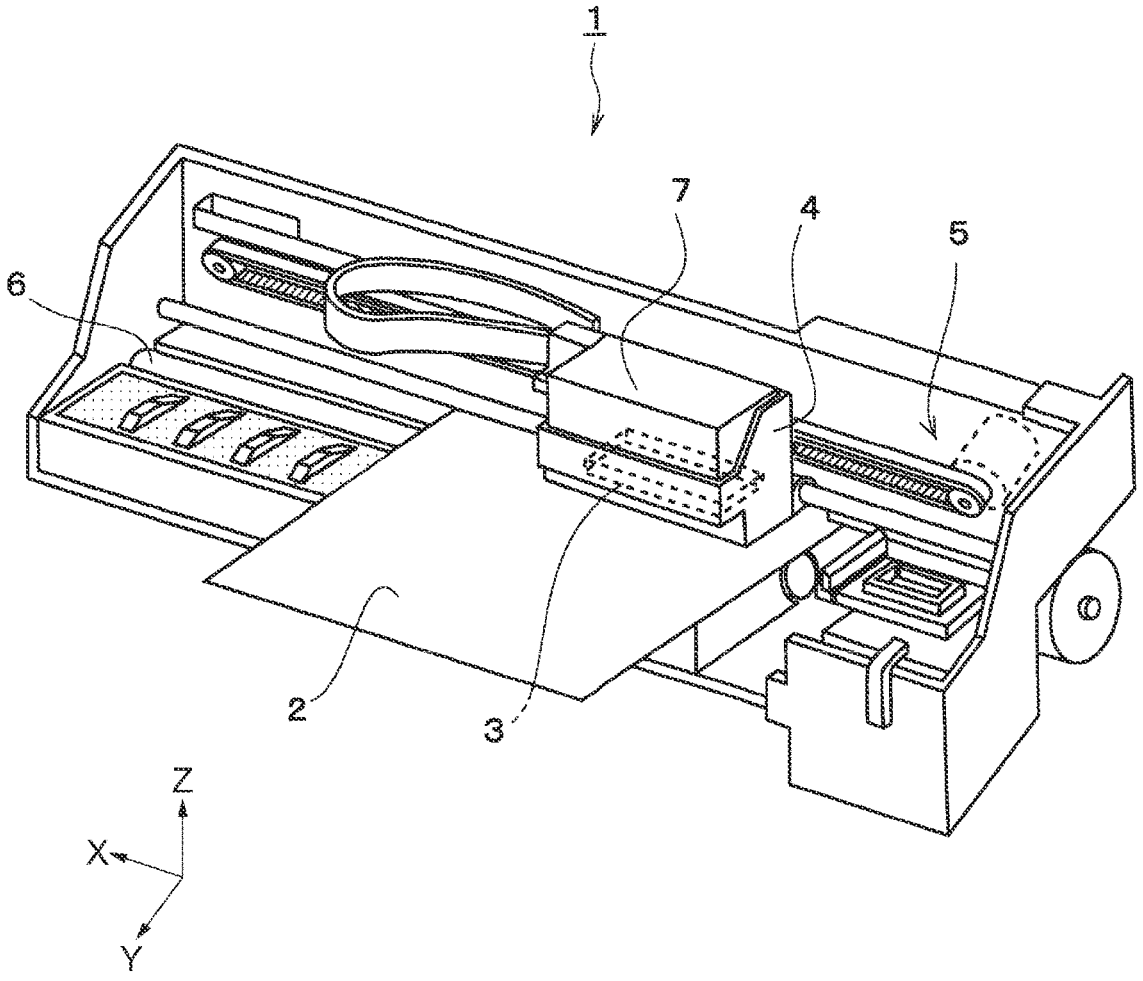
FIG. 1 is a perspective view illustrating a configuration of a printer.

A configuration of a printer 1 according to a first embodiment will be described with reference to FIG. 1. The printer 1 is a device that discharges liquid ink onto a surface of a recording medium 2 such as recording paper to record an image or the like. This printer 1 includes a recording head configured to discharge ink, a carriage 4 to which the recording head 3 is attached, a carriage moving mechanism 5 configured to move the carriage 4 in a main-scanning direction, a platen roller 6 configured to transfer the recording medium 2 in a sub-scanning direction, or the like. Here, the above ink is a kind of liquid and is stored in an ink cartridge 7 as a liquid supply source. The ink cartridge 7 is detachably attached to the recording head 3. It is also possible to adopt a configuration in which the ink cartridge 7 is arranged on a main body side of the printer 1 and the ink is supplied from the ink cartridge 7 to the recording head 3 through an ink supply tube. Hereinafter, the main-scanning direction is a ±X direction, the sub-scanning direction is a ±Y direction, and a direction perpendicular to the main-scanning direction and the sub-scanning direction is a ±Z direction. In the present embodiment, the +Z direction is upward and the −Z direction is downward. The ±Z direction corresponds to a first direction, and in the present specification, a view as viewed from the ±Z direction is also referred to as a plan view.

Figure 2:
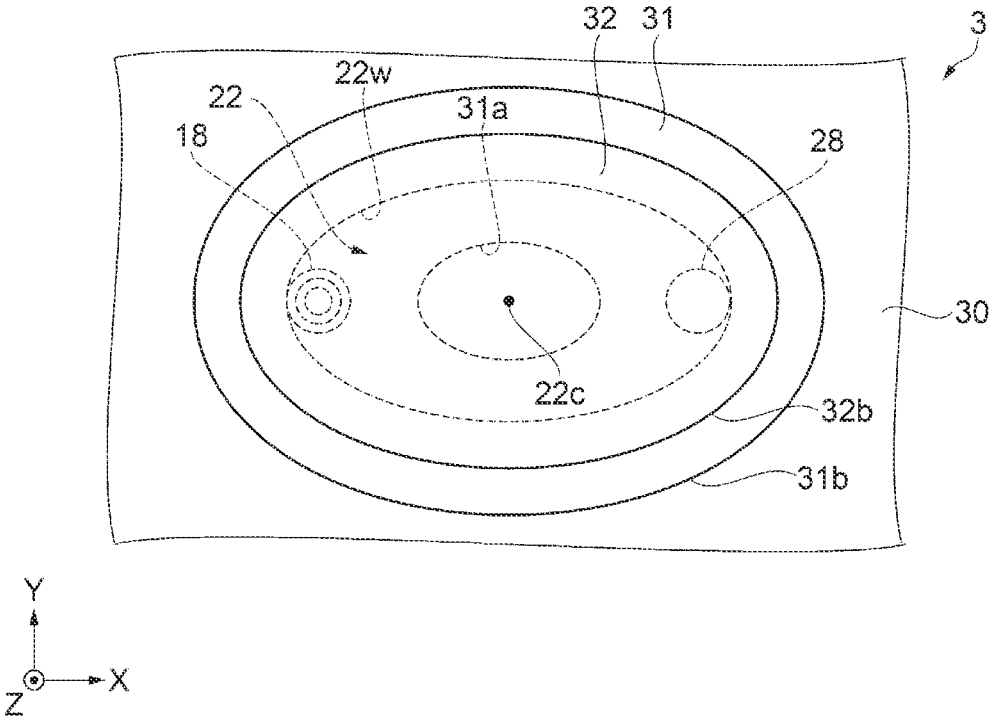
FIG. 2 is a plan view showing an upper surface of a main portion of a recording head according to a first embodiment.
Figure 3:
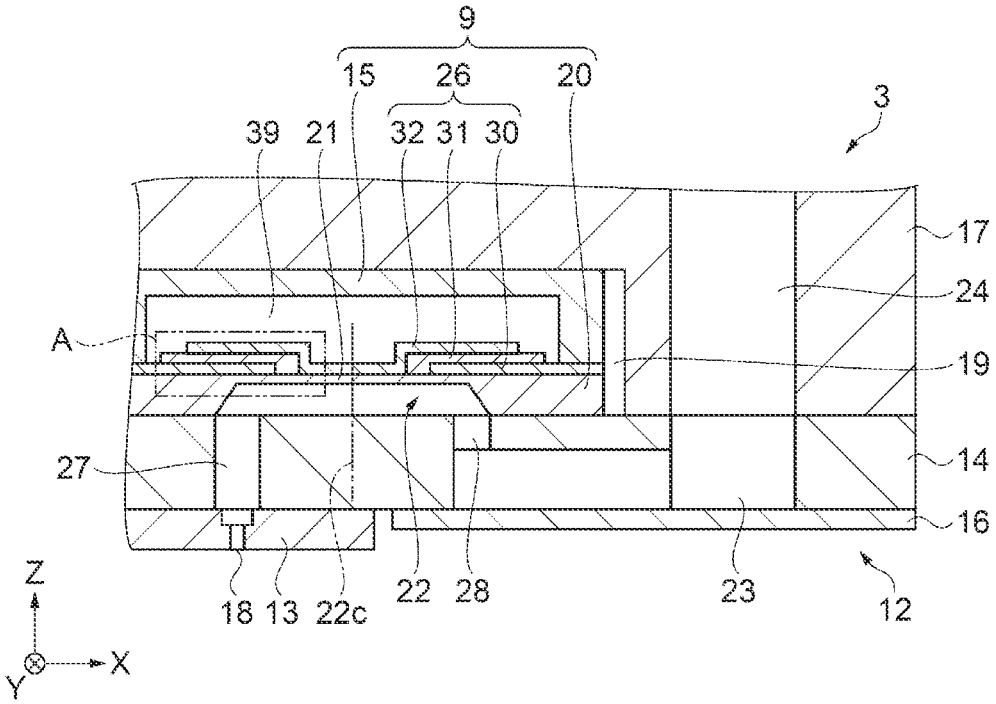
FIG. 3 is a cross-sectional view of the recording head according to the first embodiment.
Figure 4:
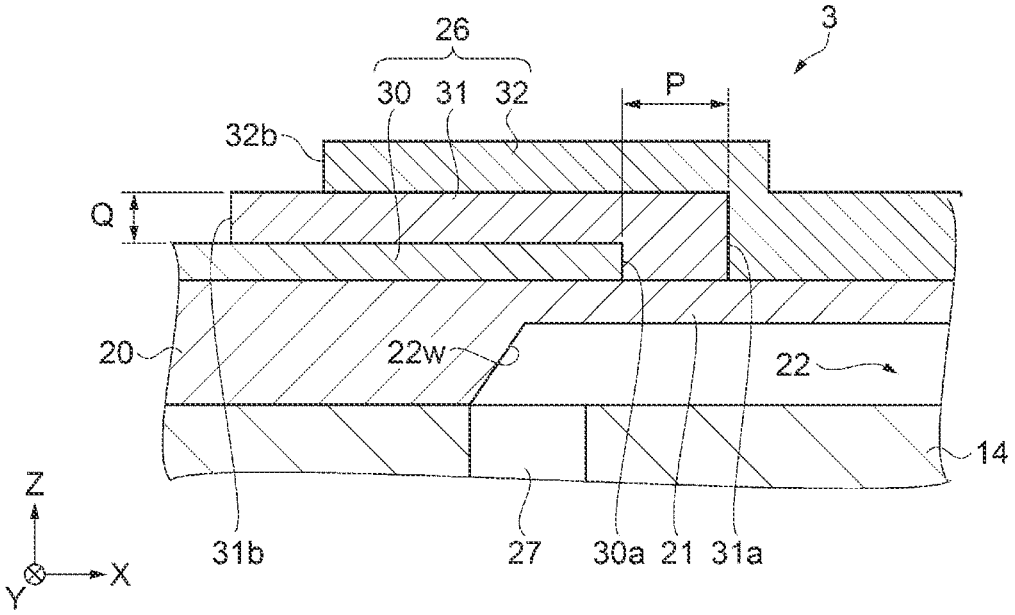
FIG. 4 is an enlarged cross-sectional view of a region A in FIG. 3.

FIGS. 2 and 3 are views illustrating a configuration of a main portion of the recording head 3. FIG. 2 is a plan view showing an upper surface of the main portion of the recording head 3, and FIG. 3 is a cross-sectional view of the recording head 3. FIG. 4 is an enlarged cross-sectional view of a region A in FIG. 3.

The recording head 3 in the present embodiment includes a pressure generating unit 9 and a flow path unit 12, and is configured to be attached to a case 17 in a state where these members are stacked. The flow path unit 12 includes a nozzle plate 13, a compliance substrate 16, and a communication substrate 14. Further, the pressure generating unit 9 is unitized by stacking a pressure chamber forming substrate 20 on which a pressure chamber 22 is formed, a piezoelectric element 26, and a sealing plate 15.

The case 17 is, for example, a box-shaped member made of a synthetic resin, and the communication substrate 14 to which the nozzle plate 13 and the pressure generating unit 9 are joined is fixed to a lower surface of the case 17. On the lower surface of the case 17, an accommodation hollow portion 19 recessed in a rectangular parallelepiped shape from the lower surface to the middle of the case 17 in a height direction (the ±Z direction) is formed. When the flow path unit 12 is joined to the lower surface of the case 17 in a state of being positioned with respect to the lower surface of the case 17, the pressure generating unit 9 stacked on the communication substrate 14 is accommodated in the accommodation hollow portion 19. Further, an ink introduction hollow portion 24 is formed in the case 17. The ink introduction hollow portion 24 is a hollow portion into which the ink from the ink cartridge 7 is introduced. The ink that flows into the ink introduction hollow portion 24 is introduced into a common liquid chamber 23 (described later) of the communication substrate 14.

Figure 5:
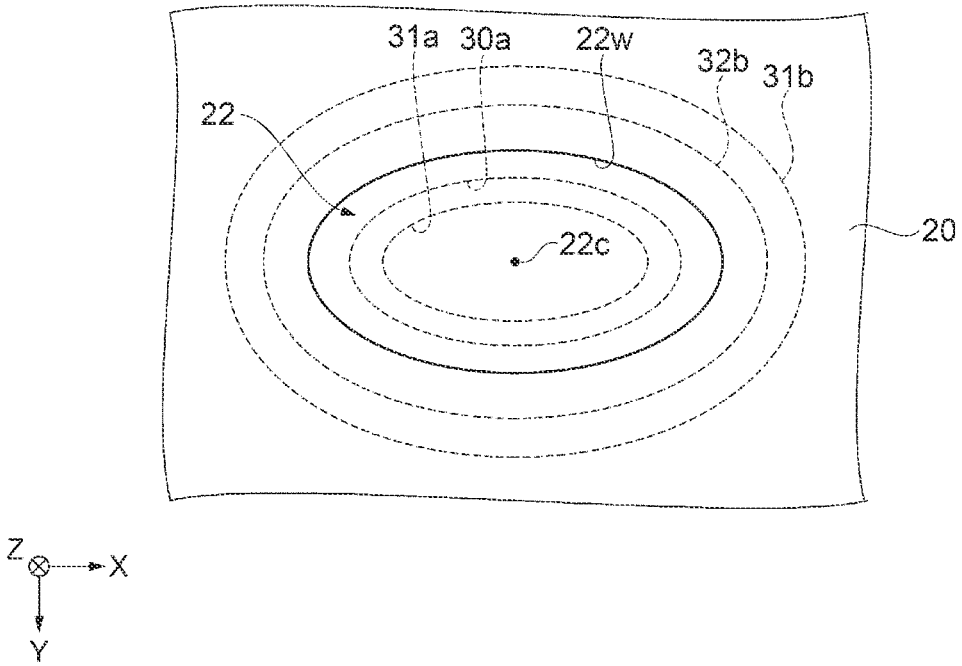
FIG. 5 is a bottom view of a pressure chamber forming substrate.

FIG. 5 is a bottom view of the pressure chamber forming substrate 20 and is a view seen from a joint surface side with the communication substrate 14. The pressure chamber forming substrate 20 which is a constituent member of the pressure generating unit 9 is made of a silicon single crystal substrate (hereinafter, also simply referred to as a silicon substrate). A plurality of pressure chambers 22 are formed in the pressure chamber forming substrate 20 corresponding to a plurality of nozzles 18 provided on the nozzle plate 13. The pressure chamber 22 is a space formed in the middle of the pressure chamber forming substrate 20 in a thickness direction (the ±Z direction) by etching the pressure chamber forming substrate 20 from a lower surface side and leaving a thin portion having a small thickness on an upper surface side. The thin portion constitutes one wall surface of the pressure chamber 22, and functions as a vibration plate 21 that deforms as the piezoelectric element 26 is driven. That is, in the present embodiment, the pressure chamber forming substrate 20 and the vibration plate 21 are integrally formed. The pressure chamber 22 is partitioned by closing an opening portion on the lower surface side of the pressure chamber 22 with the communication substrate 14 described later. The pressure chambers 22 of the present embodiment form a row along the ±Y direction together with the plurality of nozzles 18 provided on the nozzle plate 13.

The pressure chamber 22 in the present embodiment has a substantially elliptical shape that is long in the ±X direction in a plan view seen from a stacking direction of the pressure chamber forming substrate 20, the communication substrate 14, and other constituent members, in other words, in a plan view seen from the ±Z direction orthogonal to the vibration plate 21. A length of the pressure chamber 22 in a longitudinal direction is, for example, 300 μm. Further, a side wall 22*w* forming an end portion of the pressure chamber in the plan view is inclined with respect to upper and lower surfaces of the pressure chamber forming substrate 20. Specifically, the side wall 22*w* is inclined in a state of being closer to the inside of the pressure chamber 22 as approaching the upper surface of the pressure chamber forming substrate 20. One pressure chamber 22 is provided to correspond to one nozzle 18 of the nozzle plate 13. That is, a formation pitch between the pressure chambers 22 corresponds to a formation pitch between the nozzles 18. In the present embodiment, the side wall 22*w* at the end portion of the pressure chamber 22 is inclined with respect to the upper and lower surfaces of the pressure chamber forming substrate 20. However, since the inclination is derived from a plane orientation of the silicon single crystal substrate forming the pressure chamber 22, by using the silicon single crystal substrate with different plane orientations, the side wall 22*w* may be inclined perpendicular to the upper and lower surfaces of the pressure chamber forming substrate 20 or in a direction opposite of that of the present embodiment. Hereinafter, the side wall 22*w* is also referred to as the end portion 22*w* of the pressure chamber 22.

When the pressure chamber forming substrate 20 is joined to the communication substrate 14 in a state of being positioned with respect to the communication substrate 14, one end side of the pressure chamber 22 in the longitudinal direction communicates with the nozzle 18 via a nozzle communication passage 27 of the communication substrate 14 described later. Further, the other end side of the pressure chamber 22 in the longitudinal direction communicates with the common liquid chamber 23 via a supply port 28 of the communication substrate 14.

The piezoelectric element 26 is formed at a position corresponding to each pressure chamber 22 on the upper surface of the pressure chamber forming substrate 20, that is, a position corresponding to the vibration plate 21. The piezoelectric element 26 in the present embodiment is a so-called bending mode piezoelectric element. The piezoelectric element 26 is formed by sequentially stacking a lower electrode 30 made of a metal, a piezoelectric body 31 made of lead zirconate titanate (PZT), and an upper electrode 32 made of a metal on the pressure chamber forming substrate 20, that is, on the vibration plate 21. That is, the lower electrode 30 is formed on the vibration plate 21, the piezoelectric body 31 is formed on the lower electrode 30, and the upper electrode 32 is formed on the piezoelectric body 31. Further, the lower electrode 30 and the piezoelectric body 31 are formed with openings for exposing the vibration plate 21. Therefore, the upper electrode 32 is formed on the piezoelectric body 31 and the vibration plate 21. The piezoelectric element 26 deforms the vibration plate 21 by being driven from the outside, and changes a volume of the pressure chamber 22. Accordingly, the ink is discharged from the nozzles 18. Details of the piezoelectric element 26 will be described later.

In the present embodiment, the upper electrode 32 is an individual electrode for each piezoelectric element 26. Further, the lower electrode 30 is a common electrode common to a plurality of piezoelectric elements 26. Then, in the plan view, a portion where the upper electrode 32, the piezoelectric body 31, and the lower electrode 30 overlap is an active portion in which piezoelectric distortion is generated by applying a voltage to both the electrodes 30 and 32. It is also possible to adopt a configuration in which the upper electrode 32 is a common electrode and the lower electrode 30 is an individual electrode.

The sealing plate 15 is arranged on an upper surface of the communication substrate 14 on which the piezoelectric element 26 is formed. The sealing plate 15 is made of, for example, glass, a ceramic material, a silicon single crystal substrate, a metal, or a synthetic resin. The sealing plate 15 is formed, in a region facing the piezoelectric element 26, with a piezoelectric element accommodation hollow portion 39 having a size that does not hinder the driving of the piezoelectric element 26. The sealing plate 15 is joined to the upper surface of the communication substrate 14 in a state where mainly the active portion of the piezoelectric element 26 is accommodated in the piezoelectric element accommodation hollow portion 39. The sealing plate 15 is formed with a wiring hollow portion (not shown) penetrating in a thickness direction of the substrate, and an electrode terminal extending from the piezoelectric element 26 is arranged in the wiring hollow portion. A terminal of a wiring member (not shown) is electrically coupled to the electrode terminal.

The nozzle plate 13 and the compliance substrate 16 are joined to the lower surface of the communication substrate 14. The nozzle plate 13 is a plate material in which the plurality of nozzles 18 are opened, and is made of a silicon substrate in the present embodiment. Then, the cylindrical nozzles 18 are formed by dry-etching the substrate. The nozzle plate 13 is joined to the lower surface of the communication substrate 14 in a state where each nozzle 18 communicates with the nozzle communication passage 27 of the communication substrate 14. The compliance substrate 16 is a member having flexibility joined to the lower surface of the communication substrate 14 in a state where an opening of the common liquid chamber 23 is closed. The compliance substrate 16 has a function of absorbing a pressure change of the ink in the common liquid chamber 23.

The communication substrate 14 is a plate material made of a silicon substrate in the same manner as the pressure chamber forming substrate 20. In the communication substrate 14, hollow portions serving as the nozzle communication passage 27 and the common liquid chamber 23 are formed by anisotropic etching. A plurality of nozzle communication passages 27 are formed corresponding to the pressure chambers 22 along the ±Y direction, in which the pressure chambers 22 are provided in parallel. Each nozzle communication passage 27 communicates with the one end side of the corresponding pressure chamber 22 in the longitudinal direction. The common liquid chamber 23 is a hollow portion extending along the ±Y direction. When the communication substrate 14 is joined to the case 17 in the state of being positioned with respect to the case 17, the common liquid chamber 23 communicates with the ink introduction hollow portion 24, and the ink from the ink cartridge 7 is introduced into the common liquid chamber 23 through the ink introduction hollow portion 24. The common liquid chamber 23 and each pressure chamber 22 communicate with each other through the supply port 28 individually provided for each pressure chamber. Therefore, the ink in the common liquid chamber 23 is supplied to each pressure chamber 22 through the supply port 28.

As described above, the lower electrode 30 of the piezoelectric element 26 is the common electrode formed on the pressure chamber forming substrate 20, and in the plan view, the lower electrode 30 has an outer shape larger than that of the piezoelectric element accommodation hollow portion 39 and is formed so as to extend over the plurality of pressure chambers 22. Further, the lower electrode 30 is formed with an opening having a shape the same as the pressure chamber 22, that is, a substantially elliptical opening with a long axis in a ±X-axis direction, at a position overlapping a central portion 22*c* of each pressure chamber 22 in the plan view. An end surface 30*a* of the lower electrode 30 forming the opening is located between the central portion 22*c* of the pressure chamber 22 and the end portion 22*w* of the pressure chamber 22, that is, on the vibration plate 21. In this way, the lower electrode 30 does not overlap the central portion 22*c* of the pressure chamber 22 in the plan view.

The piezoelectric body 31 has a substantially elliptical shape with a long axis in the ±X-axis direction in the plan view, and an outer shape thereof is larger than that of the pressure chamber 22 and is sized to fit in the piezoelectric element accommodation hollow portion 39. That is, an end surface 31*b* forming the outer shape of the piezoelectric body 31 is located on the lower electrode 30. Further, similar to the lower electrode 30, the piezoelectric body 31 is formed with a substantially elliptical opening with a long axis in the ±X-axis direction at the position overlapping the central portion 22*c* of each pressure chamber 22 in the plan view. An end surface 31*a* of the piezoelectric body 31 forming the opening is located between the central portion 22*c* of the pressure chamber 22 and the end portion 22*w* of the pressure chamber 22, that is, on the vibration plate 21. In this way, the piezoelectric body 31 does not overlap the central portion 22*c* of the pressure chamber 22 in the plan view. Further, the end face 31*a* is located closer to the central portion 22*c* of the pressure chamber 22 than the end surface 30*a* of the lower electrode 30. In other words, in the plan view, a distance between the end surface 31*a* and the central portion 22*c* is shorter than a distance between the end surface 30*a* and the central portion 22*c*. The piezoelectric body 31 of the present embodiment is formed such that a distance P between the end surface 31*a* and the end surface 30*a* is equal to or greater than a thickness Q of the piezoelectric body 31 on the lower electrode 30.

The upper electrode 32 also has a substantially elliptical shape with a long axis in the ±X-axis direction in the plan view, and an outer shape thereof is smaller than the outer shape of the piezoelectric body 31 and larger than the opening of the piezoelectric body 31. Therefore, an end surface 32*b* forming the outer shape of the upper electrode 32 is located on the piezoelectric body 31. Unlike the lower electrode 30 and the piezoelectric body 31, the upper electrode 32 is not formed with an opening. That is, the upper electrode 32 is formed so as to overlap the central portion 22*c* of the pressure chamber 22 in the plan view, and to cover the vibration plate 21 exposed from the opening of the piezoelectric body 31 and cover at least a part of the piezoelectric body 31.

The above active portion, that is, the portion where the lower electrode 30, the piezoelectric body 31 and the upper electrode 32 overlap is arranged on the pressure chamber forming substrate 20 so as to overlap the end portion 22*w* of the pressure chamber 22 in the plan view.

In the present embodiment, the central portion 22*c* of the pressure chamber 22 is defined as a position where a displacement of the vibration plate 21 in the ±Z direction is maximum when the piezoelectric element 26 is driven. Further, a combination of the vibration plate 21 and the piezoelectric element 26 formed on the vibration plate 21 corresponds to a piezoelectric actuator. A plurality of piezoelectric actuators are formed in the recording head 3 since the piezoelectric actuator is provided for each pressure chamber 22.

As described above, in the recording head 3 having the above configuration, the upper electrode 32 is formed on the piezoelectric body 31 on the pressure chamber forming substrate 20 so as to cover the opening of the piezoelectric body 31. Therefore, it is possible to prevent moisture from directly adhering to the end surface 31*a* of the piezoelectric body 31 forming the opening of the piezoelectric body 31 and an interface between the piezoelectric body 31 and the pressure chamber forming substrate 20. As a result, it is possible to prevent an increase in a leakage current due to the moisture adhering to the piezoelectric body 31 in a high humidity environment. Further, when the moisture adheres to the piezoelectric body 31 to which the voltage is applied, hydrogen atoms or hydrogen ions are generated from the moisture to deprive the piezoelectric body 31 of oxygen, and a change in a crystal structure of the piezoelectric body 31 and a decrease in a polarization value may be caused. However, in the present embodiment, since the moisture is prevented from directly adhering to the piezoelectric body 31, a possibility of the change in the crystal structure of the piezoelectric body 31 and the decrease in the polarization value can be reduced.

Further, in the present embodiment, the distance P between the end surface 31*a* of the piezoelectric body 31 and the end surface 30*a* of the lower electrode 30 is set to be equal to or greater than the thickness Q of the piezoelectric body 31 on the lower electrode 30. A lower limit of the thickness Q of the piezoelectric body 31 on the lower electrode 30 is a film thickness that can ensure an insulating property between the lower electrode 30 and the upper electrode 32. Therefore, when the distance P between the end surface 31*a* and the end surface 30*a* is smaller than the thickness Q of the piezoelectric body 31 on the lower electrode 30, the insulating property of the piezoelectric body 31 cannot be sufficiently ensured, and the leakage current may increase. In contrast, in the present embodiment, the piezoelectric element 26 is formed such that the distance P between the end surface 31*a* and the end surface 30*a* is equal to or greater than the thickness Q of the piezoelectric body 31 on the lower electrode 30, so that it is possible to sufficiently ensure the insulating property of the piezoelectric body 31, and it is possible to prevent the leakage current. The end surface 31*a* of the piezoelectric body 31 corresponds to a first end surface, and the end surface 30*a* of the lower electrode 30 corresponds to a second end surface.

2. Second Embodiment

Figure 6:
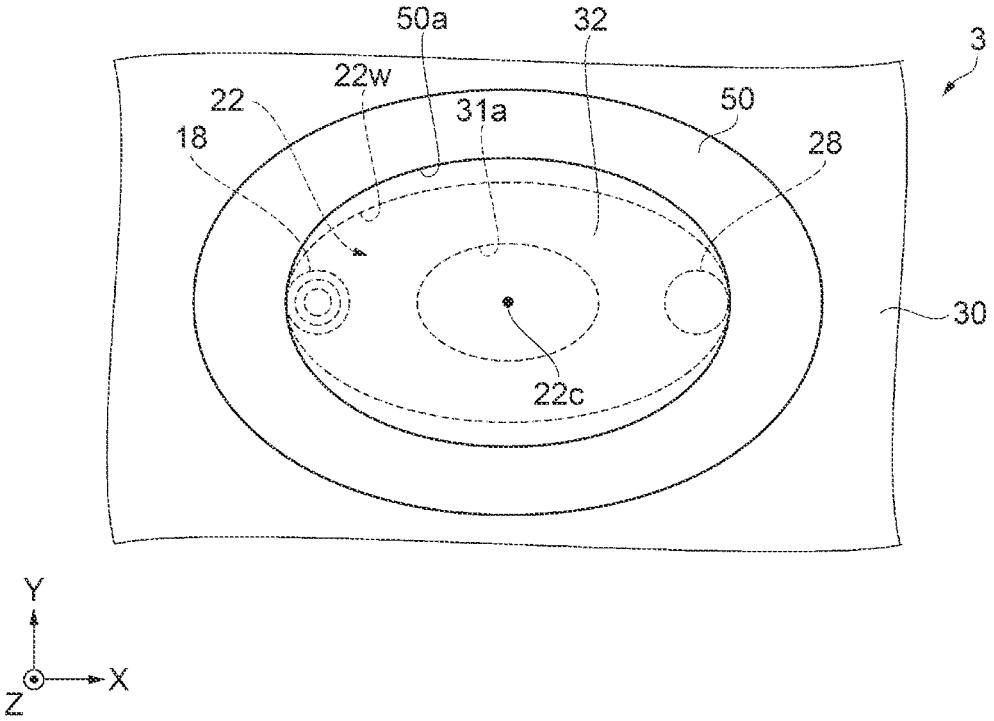
FIG. 6 is a plan view showing an upper surface of a main portion of a recording head according to a second embodiment.
Figure 7:
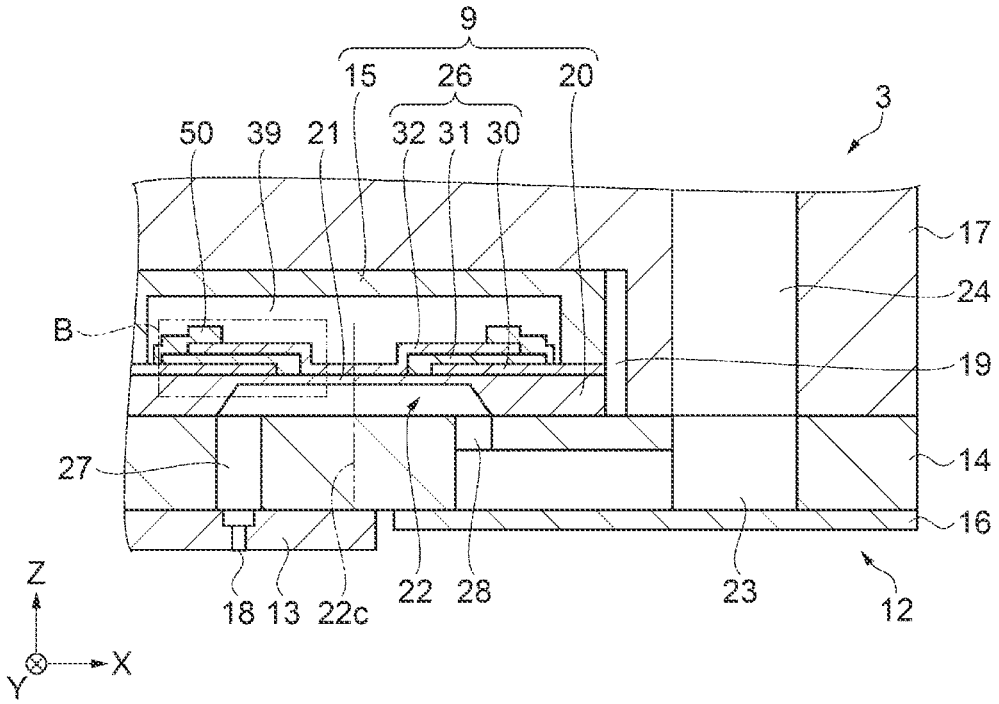
FIG. 7 is a cross-sectional view of the recording head according to the second embodiment.
Figure 8:
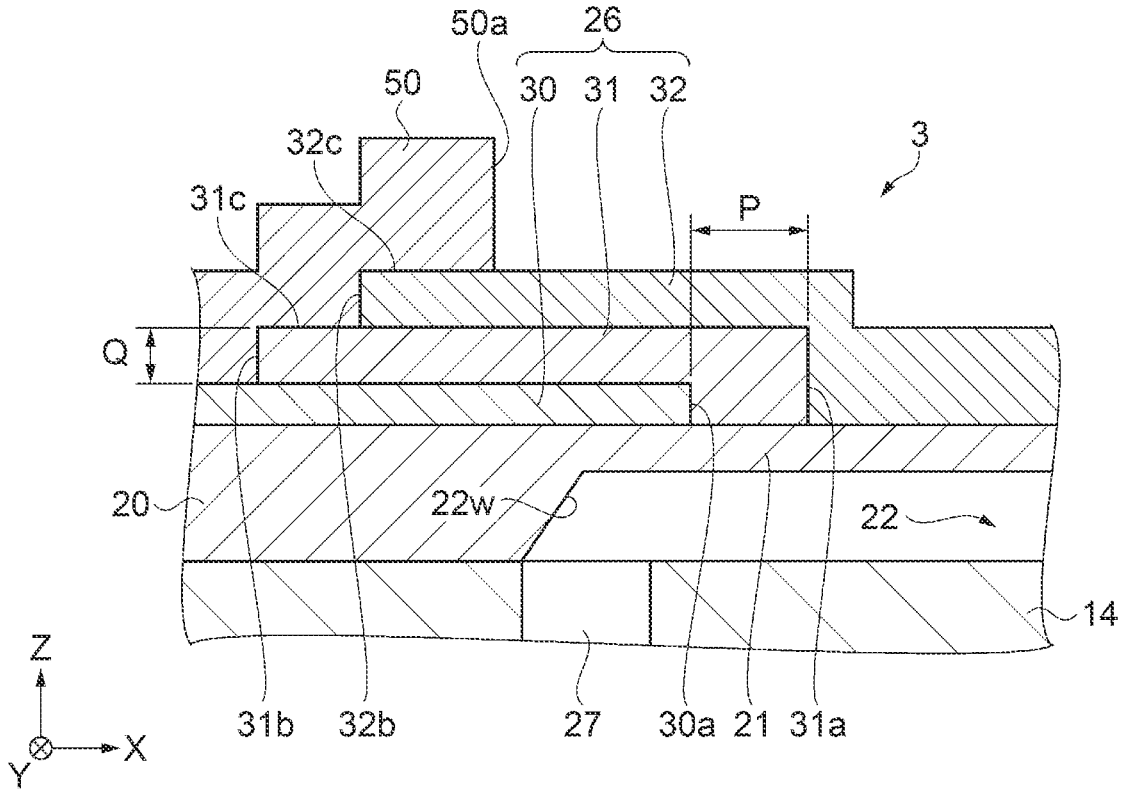
FIG. 8 is an enlarged cross-sectional view of a region B in FIG. 7.

FIGS. 6 and 7 are views illustrating a configuration of the recording head 3 according to a second embodiment. FIG. 6 is a plan view showing an upper surface of a main portion of the recording head 3, and FIG. 7 is a cross-sectional view of the recording head 3. FIG. 8 is an enlarged cross-sectional view of a region B in FIG. 7.

A piezoelectric actuator of the present embodiment is different from that of the first embodiment in that a protective film 50 having a property of not allowing the moisture to permeate is provided on a region of the piezoelectric element 26 outside the end portion 22*w* of the pressure chamber 22 in the plan view. Other configurations are similar to those of the first embodiment.

The protective film 50 is formed of, for example, nitrides such as TiN, SiN, AlN, or TiAlN, oxides such as AlOx, TiOx, TaOx, CrOx, or IrOx, resin-based materials such as parylene and adhesives, and carbon-based materials such as diamond-like carbon.

Similar to the pressure chamber 22, the protective film 50 has a substantially elliptical shape with a long axis in the ±X-axis direction in the plan view, and an outer shape thereof is larger than that of the piezoelectric body 31 and is sized to fit in the piezoelectric element accommodation hollow portion 39. Further, the protective film 50 is formed with a substantially elliptical opening with a long axis in the ±X-axis direction at the position overlapping the central portion 22*c* of each pressure chamber 22 in the plan view. An end surface 50*a* of the protective film 50 forming the opening is located outside the end portion 22*w* of the pressure chamber 22 on the upper electrode 32 in the plan view.

In this way, in the present embodiment, the protective film 50 is formed on the upper electrode 32, the piezoelectric body 31, and the lower electrode 30 outside the end portion 22*w* of the pressure chamber 22 in the plan view. The protective film 50 covers an upper surface 32*c* of the upper electrode 32, the end surface 32*b* forming the outer shape of the upper electrode 32, an upper surface 31*c* of the piezoelectric body 31, and the end surface 31*b* forming the outer shape of the piezoelectric body 31. Therefore, it is possible to prevent the moisture from directly adhering to an interface between the piezoelectric body 31 and the upper electrode 32, the end surface 31*b* of the piezoelectric body 31, and an interface between the piezoelectric body 31 and the lower electrode 30, so that the increase in the leakage current in the high humidity environment is further prevented.

In the present embodiment, the upper surface 32*c* of the upper electrode 32 on an opposite side of the piezoelectric body 31 and the vibration plate 21 corresponds to the first surface, and the end surface 32*b* of the upper electrode 32 corresponds to a side surface intersecting the upper surface 32*c*.

3. Third Embodiment

Figure 9:
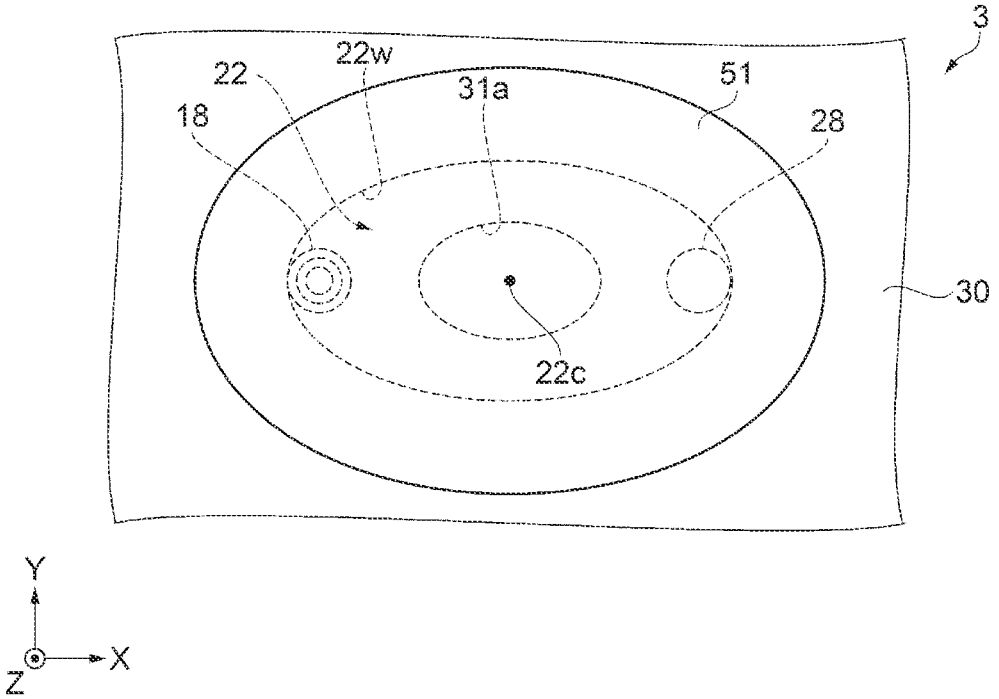
FIG. 9 is a plan view showing an upper surface of a main portion of a recording head according to a third embodiment.
Figure 10:
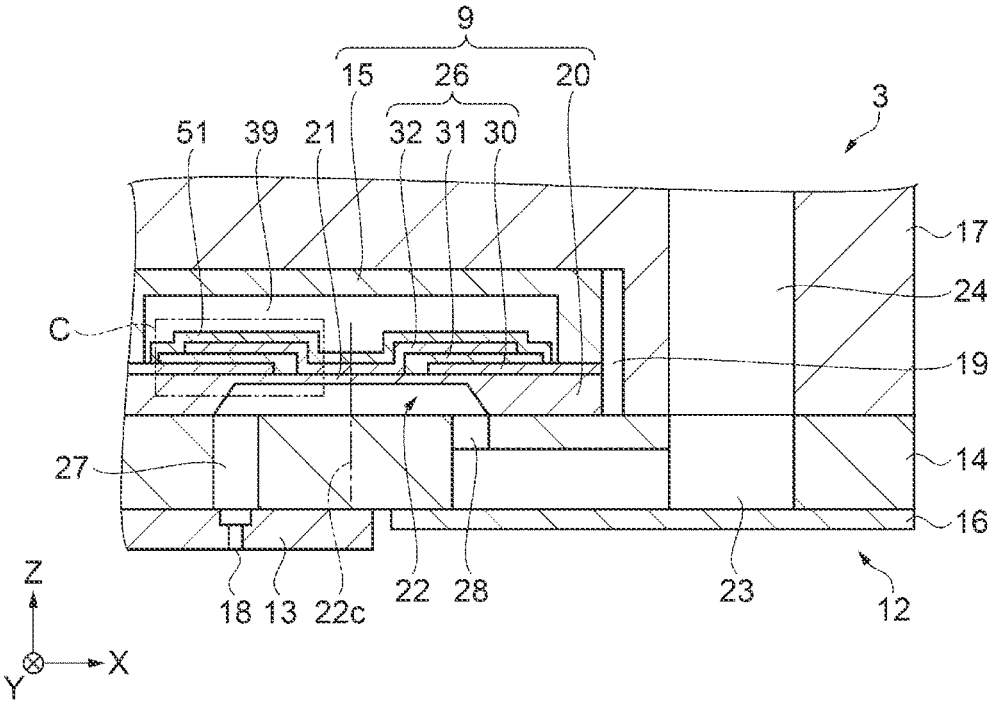
FIG. 10 is a cross-sectional view of the recording head according to the third embodiment.
Figure 11:
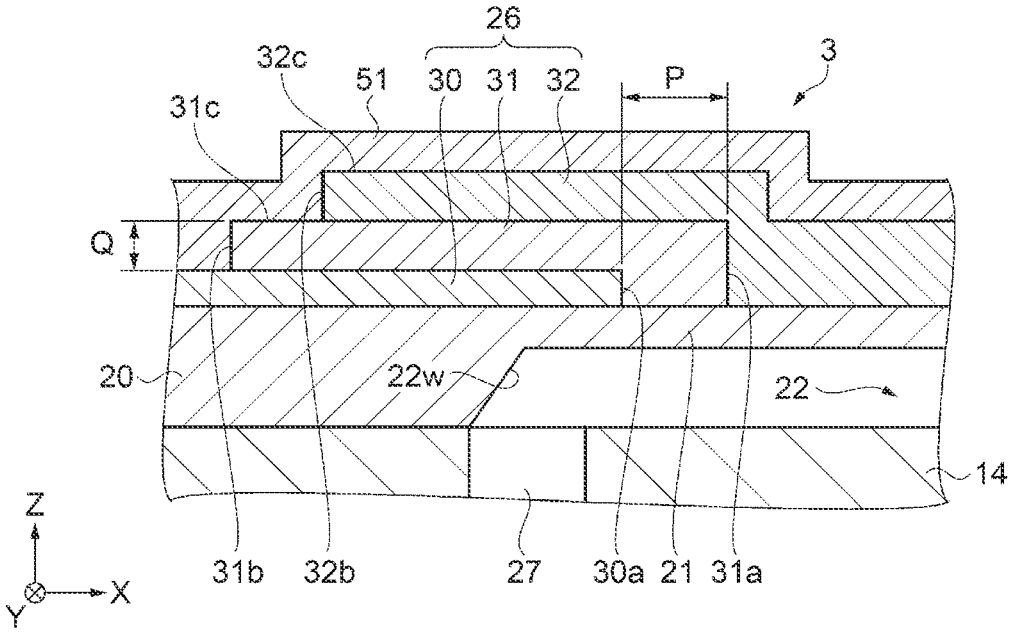
FIG. 11 is an enlarged cross-sectional view of a region C in FIG. 10.

FIGS. 9 and 10 are views illustrating a configuration of the recording head 3 according to a third embodiment. FIG. 9 is a plan view showing an upper surface of a main portion of the recording head 3, and FIG. 10 is a cross-sectional view of the recording head 3. FIG. 11 is an enlarged cross-sectional view of a region C in FIG. 10.

In the present embodiment, a protective film 51 is formed on the piezoelectric element 26 as in the second embodiment, but a shape thereof is different from that of the protective film 50 of the second embodiment. Other configurations are similar to those of the second embodiment.

Specifically, similar to the protective film 50 of the second embodiment, the protective film 51 has a substantially elliptical shape with a long axis in the ±X-axis direction in the plan view, and an outer shape thereof is larger than that of the piezoelectric body 31 and is sized to fit in the piezoelectric element accommodation hollow portion 39. However, unlike the protective film 50 of the second embodiment, the protective film 51 does not have an opening.

In this way, in the present embodiment, the protective film 51 is formed on the upper electrode 32, the piezoelectric body 31, and the lower electrode 30 on the pressure chamber forming substrate 20. The protective film 51 covers the upper surface 32*c* of the upper electrode 32, the end surface 32*b* forming the outer shape of the upper electrode 32, the upper surface 31*c* of the piezoelectric body 31, and the end surface 31*b* forming the outer shape of the piezoelectric body 31. Therefore, it is possible to prevent the moisture from directly adhering to the interface between the piezoelectric body 31 and the upper electrode 32, the end surface 31*b* of the piezoelectric body 31, and the interface between the piezoelectric body 31 and the lower electrode 30, so that the increase in the leakage current in the high humidity environment is further prevented. Further, since the protective film 51 of the present embodiment does not have an opening, the number of etching steps can be reduced as compared with the second embodiment.

4. Fourth Embodiment

Figure 12:
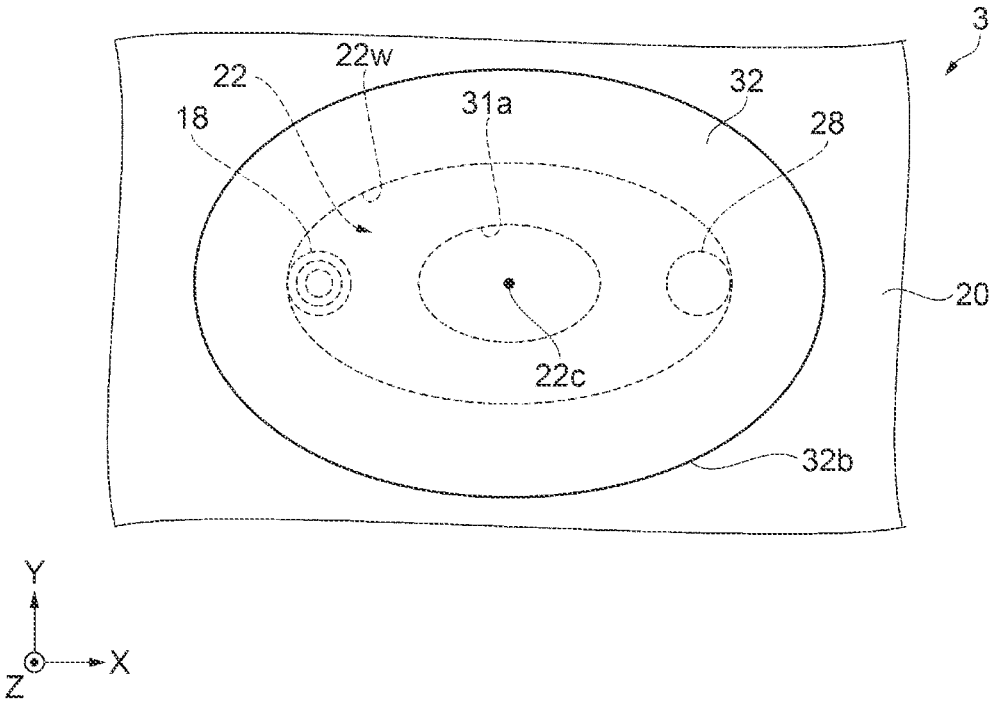
FIG. 12 is a plan view showing an upper surface of a main portion of a recording head according to a fourth embodiment.
Figure 13:
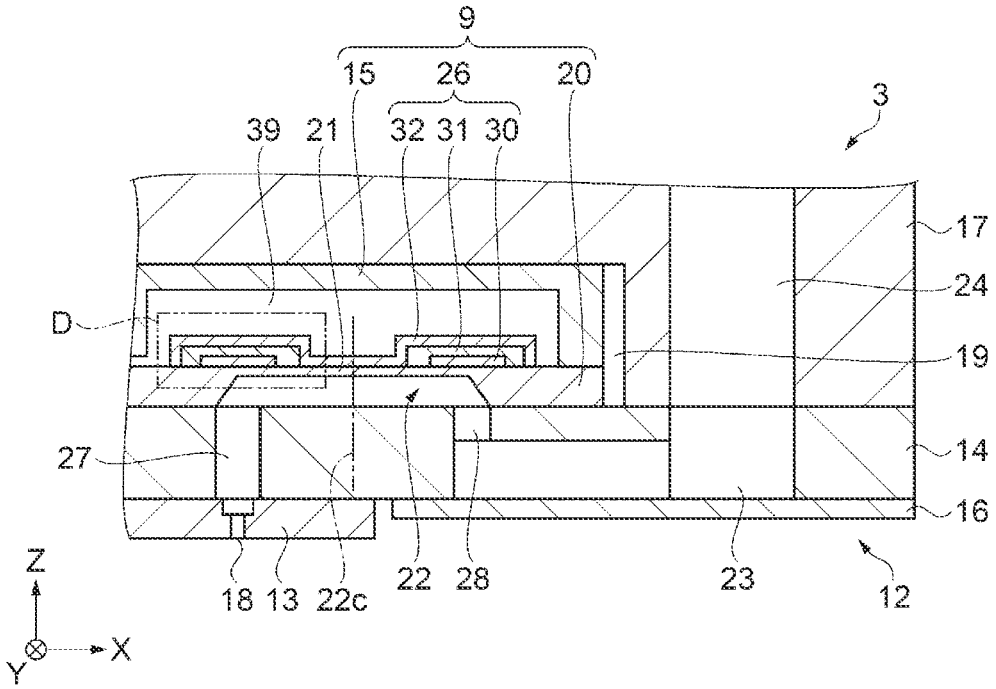
FIG. 13 is a cross-sectional view of the recording head according to the fourth embodiment.
Figure 14:
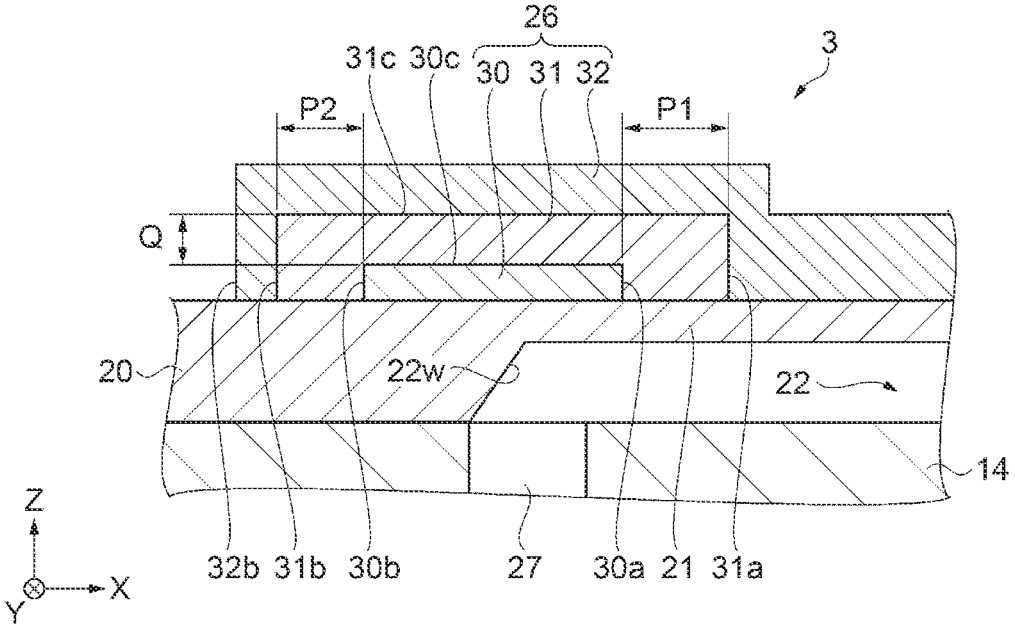
FIG. 14 is an enlarged cross-sectional view of a region D in FIG. 13.

FIGS. 12 and 13 are views illustrating a configuration of the recording head 3 according to a fourth embodiment. FIG. 12 is a plan view showing an upper surface of a main portion of the recording head 3, and FIG. 13 is a cross-sectional view of the recording head 3. FIG. 14 is an enlarged cross-sectional view of a region D in FIG. 13.

In the present embodiment, a configuration of the piezoelectric element 26 is different from that of the first embodiment. Other configurations are similar to those of the first embodiment.

In the present embodiment, the lower electrode 30 of the piezoelectric element 26 is an individual electrode formed for each pressure chamber 22, that is, for each piezoelectric actuator, and the upper electrode 32 is a common electrode common to the plurality of piezoelectric actuators. The lower electrode 30 has a substantially elliptical shape with a long axis in the ±X-axis direction in the plan view, and an outer shape thereof is larger than that of the pressure chamber 22 and is sized to fit in the piezoelectric element accommodation hollow portion 39. That is, an end surface 30*b* forming the outer shape of the lower electrode 30 is located on the pressure chamber forming substrate 20 outside the end portion 22*w* of the pressure chamber 22 in the plan view. Further, the lower electrode 30 is formed with a substantially elliptical opening with a long axis in the ±X-axis direction at the position overlapping the central portion 22*c* of each pressure chamber 22 in the plan view. The end surface 30*a* of the lower electrode 30 forming the opening is located between the central portion 22*c* of the pressure chamber 22 and the end portion 22*w* of the pressure chamber 22, that is, on the vibration plate 21. In this way, the lower electrode 30 does not overlap the central portion 22*c* of the pressure chamber 22 in the plan view.

The piezoelectric body 31 has a substantially elliptical shape with a long axis in the ±X-axis direction in the plan view, and an outer shape thereof is larger than that of the lower electrode 30 and is sized to fit in the piezoelectric element accommodation hollow portion 39. Further, the end surface 31*b* forming the outer shape of the piezoelectric body 31 is located on the pressure chamber forming substrate 20 farther from the central portion 22*c* of the pressure chamber 22 than the end surface 30*b* forming the outer shape of the lower electrode 30. In other words, in the plan view, a distance between the end surface 31*b* and the central portion 22*c* is longer than a distance between the end surface 30*b* and the central portion 22*c*. Further, similar to the lower electrode 30, the piezoelectric body 31 is formed with a substantially elliptical opening with a long axis in the ±X-axis direction at the position overlapping the central portion 22*c* of each pressure chamber 22 in the plan view. The end surface 31*a* of the piezoelectric body 31 forming the opening is located between the central portion 22*c* of the pressure chamber 22 and the end portion 22*w* of the pressure chamber 22, that is, on the vibration plate 21. In this way, the piezoelectric body 31 does not overlap the central portion 22*c* of the pressure chamber 22 in the plan view. Further, the end face 31*a* is located closer to the central portion 22*c* of the pressure chamber 22 than the end surface 30*a* of the lower electrode 30. In other words, in the plan view, the distance between the end surface 31*a* and the central portion 22*c* is shorter than the distance between the end surface 30*a* and the central portion 22*c*. The piezoelectric body 31 of the present embodiment is formed such that both a distance P1 between the end surface 31*a* and the end surface 30*a* and a distance P2 between the end surface 31*b* and the end surface 30*b* are equal to or greater than the thickness Q of the piezoelectric body 31 on the lower electrode 30.

The upper electrode 32 also has a substantially elliptical shape with a long axis in the ±X-axis direction in the plan view, and an outer shape thereof is larger than the piezoelectric body 31. Therefore, the end surface 32*b* forming the outer shape of the upper electrode 32 is located on the pressure chamber forming substrate 20. Further, since the upper electrode 32 is the common electrode, the upper electrode 32 is coupled to the upper electrode 32 on the adjacent pressure chamber 22 via a wiring (not shown). Further, unlike the lower electrode 30 and the piezoelectric body 31, the upper electrode 32 is not formed with an opening. That is, the upper electrode 32 is formed so as to overlap the central portion 22*c* of the pressure chamber 22 in the plan view, and to cover the vibration plate 21 exposed from the opening of the piezoelectric body 31 and cover the upper surface 31*c* and the end surfaces 31*a* and 31*b* of the piezoelectric body 31.

The above active portion, that is, the portion where the lower electrode 30, the piezoelectric body 31 and the upper electrode 32 overlap is arranged on the pressure chamber forming substrate 20 so as to overlap the end portion 22*w* of the pressure chamber 22 in the plan view.

As described above, in the recording head 3 having the above configuration, on the pressure chamber forming substrate 20, the upper surface 30*c* of the lower electrode 30 and the end surfaces 30*a* and 30*b* of the lower electrode 30 are covered with the piezoelectric body 31, and the upper surface 31*c* of the piezoelectric body 31 and the end surfaces 31*a* and 31*b* of the piezoelectric body 31 are covered with the upper electrode 32. Therefore, since an exposure of the piezoelectric body 31 can be eliminated without forming the protective films 50 and 51, the increase in the leakage current due to the adhesion of the moisture to the piezoelectric body 31 is further prevented.

Further, in the present embodiment, both the distance P1 between the end surface 31*a* of the piezoelectric body 31 and the end surface 30*a* of the lower electrode 30 and the distance P2 between the end surface 31*b* of the piezoelectric body 31 and the end surface 30*b* of the lower electrode 30 are set to be equal to or greater than the thickness Q of the piezoelectric body 31 on the lower electrode 30. The lower limit of the thickness Q of the piezoelectric body 31 on the lower electrode 30 is the film thickness that can ensure the insulating property between the lower electrode 30 and the upper electrode 32. Therefore, when the distance P1 between the end surface 31*a* and the end surface 30*a* and the distance P2 between the end surface 31*b* and the end surface 30*b* are smaller than the thickness Q of the piezoelectric body 31 on the lower electrode 30, the insulating property of the piezoelectric body 31 cannot be sufficiently ensured, and the leakage current may increase. In contrast, in the present embodiment, the piezoelectric element 26 is formed such that the distance P1 between the end surface 31*a* and the end surface 30*a* and the distance P2 between the end surface 31*b* and the end surface 30*b* are equal to or greater than the thickness Q of the piezoelectric body 31 on the lower electrode 30, so that it is possible to sufficiently ensure the insulating property of the piezoelectric body 31, and it is possible to prevent the leakage current.

In the present embodiment, the upper electrode 32 is formed in the substantially elliptical shape, but the shape is optional. Further, since the upper electrode 32 is the common electrode, the upper electrode 32 may be formed so as to extend over the plurality of pressure chambers 22 in the plan view.

Further, in the present embodiment, the protective films 50 and 51 are not formed, but higher moisture resistance may be obtained by additionally forming the protective films 50 and 51 on the upper electrode 32.

In the present embodiment, the upper surface 31*c* of the piezoelectric body 31 on the opposite side of the lower electrode 30 corresponds to the second surface, and the end surfaces 31*a* and 31*b* of the piezoelectric body 31 correspond to the side surface intersecting the upper surface 31*c*.

Each of the above embodiments may be modified as follows.

In each of the above embodiments, most of components including the pressure chamber 22, the lower electrode 30, the piezoelectric body 31, the upper electrode 32, and the protective films 50 and 51 are formed in an elliptical shape in the plan view, but the shapes thereof are optional and may be, for example, circular or polygonal. However, when the shape is polygonal, it is desirable to round corners in order to alleviate stress concentration. Similarly, the shapes of the openings formed in the lower electrode 30, the piezoelectric body 31, and the protective film 50 are also not limited to the elliptical shape. Further, the shapes of a plurality of components do not have to be the same, and the components may have different shapes.

In each of the above embodiments, the lower electrode 30 and the piezoelectric body 31 are formed with one opening, but a plurality of openings may be formed in the lower electrode 30 and the piezoelectric body 31 in order to adjust stress of the piezoelectric element 26.

In each of the above embodiments, the pressure chambers 22 form the row along the ±Y direction together with the plurality of nozzles 18 provided on the nozzle plate 13, but a direction of the row may be another direction on an X-Y plane. Accordingly, the pressure chamber 22 has a substantially elliptical shape that is long in the ±X direction, but may have a long shape in another direction on the X-Y plane.

In each of the above embodiments, the recording head 3 used in the printer 1 is described as an example of the liquid discharge head, but the liquid discharge head is not limited to this aspect. For example, the liquid discharge head may be a color material discharge head used for manufacturing a color filter for a liquid crystal display, or the like, an electrode material discharge head used for an electrode formation of an organic electro luminescence (EL) display, a field emission display (FED), or the like, a bioorganic matter discharge head used for manufacturing a biochip (a biochemical element), a droplet discharge head used in a three-dimensional shaping apparatus, or the like.

What is claimed is:

1. A liquid discharge head, comprising:

a pressure chamber; and a piezoelectric actuator configured to change a volume of the pressure chamber, wherein the piezoelectric actuator includes a vibration plate forming one wall surface of the pressure chamber, a lower electrode formed on the vibration plate, a piezoelectric body formed on the lower electrode, and an upper electrode formed on the piezoelectric body and the vibration plate, when viewed from a first direction orthogonal to the vibration plate, the lower electrode and the piezoelectric body do not overlap a central portion of the pressure chamber, when viewed from the first direction, the lower electrode, the piezoelectric body, and the upper electrode overlap an end portion of the pressure chamber, when viewed from the first direction, the upper electrode overlaps the central portion of the pressure chamber, and when viewed from the first direction, the piezoelectric actuator includes a protective film formed on the upper electrode and the piezoelectric body outside the end portion of the pressure chamber.

2. The liquid discharge head according to claim 1, wherein when viewed from the first direction, a first end surface of the piezoelectric body arranged between the central portion of the pressure chamber and the end portion of the pressure chamber is closer to the central portion of the pressure chamber than a second end surface of the lower electrode arranged between the central portion of the pressure chamber and the end portion of the pressure chamber, and a distance between the first end surface of the piezoelectric body and the second end surface of the lower electrode is equal to or greater than a thickness of the piezoelectric body on the lower electrode.

3. The liquid discharge head according to claim 1, wherein the protective film covers a first surface of the upper electrode on an opposite side of the piezoelectric body and the vibration plate, and a side surface intersecting the first surface.

4. The liquid discharge head according to claim 1, wherein a plurality of the pressure chambers and the piezoelectric actuators are formed, the lower electrode is an individual electrode formed for each of the piezoelectric actuators, and the upper electrode is a common electrode common to the plurality of piezoelectric actuators, and covers a second surface of the piezoelectric body on an opposite side of the lower electrode and a side surface intersecting the second surface.

* * * * *